US005845908A

United States Patent [19]

Reichardt et al.

[11] Patent Number: 5,845,908

[45] Date of Patent: Dec. 8, 1998

[54] FLYING DISK GAME

[76] Inventors: Lloyd Franklyn Reichardt; Darren Banks, both of 7740 Calhoun St., San Bernadino, Calif. 92346

[21] Appl. No.: 939,331

[22] Filed: Sep. 29, 1997

[51] Int. Cl.[6] ..... A63F 9/00

[52] U.S. Cl. ..... 273/317

[58] Field of Search ..... 273/317, 317.5, 273/400, 402; 473/569, 588, 589

[56] References Cited

U.S. PATENT DOCUMENTS

| | | | |
|---|---|---|---|
| D. 349,930 | 8/1994 | Killion | D21/82 |
| 4,168,066 | 9/1979 | Sole et al. | 273/402 |
| 4,423,877 | 1/1984 | Cook | 273/317 |
| 5,110,139 | 5/1992 | Baumgartner | 273/400 |
| 5,316,310 | 5/1994 | Nicholas, Sr. et al. | 273/317 |
| 5,318,307 | 6/1994 | Bouchard et al. | 273/402 X |
| 5,419,566 | 5/1995 | Byrd | 273/402 |
| 5,465,976 | 11/1995 | Gonzalez | 273/317 |

*Primary Examiner*—William H. Grieb

[57] ABSTRACT

A flying disk game is provided including at least one disk with a top planar circular face and a cylindrical periphery coupled to a peripheral edge of the top planar circular face and depending downwardly therefrom. In use, the disk is placed on a palm of a first hand of a user. Thereafter, the periphery of the disk is flicked with fingers of a second hand of the user thereby imparting flight to the disk.

8 Claims, 2 Drawing Sheets

FLYING DISK GAME

BACKGROUND OF THE INVENTION

1. Field of the Invention

The present invention relates to a flying disk game and more particularly pertains to flicking a disk through an obstacle course.

2. Description of the Prior Art

The use of projectile games is known in the prior art. More specifically, projectile games heretofore devised and utilized for the purpose of providing entertainment are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 4,168,066; U.S. Pat. No. 5,316,310; U.S. Pat. Des. 349,930; U.S. Pat. No. 5,318,307; U.S. Pat. No. 5,419,566; and U.S. Pat. No. 5,110,139.

In this respect, the flying disk game according to the present invention substantially departs from the conventional concepts and designs of the prior art, and in so doing provides an apparatus primarily developed for the purpose of flicking a disk through an obstacle course.

Therefore, it can be appreciated that there exists a continuing need for a new and improved flying disk game which can be used for flicking a disk through an obstacle course. In this regard, the present invention substantially fulfills this need.

SUMMARY OF THE INVENTION

In view of the foregoing disadvantages inherent in the known types of projectile games now present in the prior art, the present invention provides an improved flying disk game. As such, the general purpose of the present invention, which will be described subsequently in greater detail, is to provide a new and improved flying disk game which has all the advantages of the prior art and none of the disadvantages.

To attain this, the present invention essentially comprises a plurality of disks each with a top planar circular face. Coupled to a peripheral edge of the top planar circular face is a cylindrical periphery which depends downwardly therefrom. As such, each disk defines an interior space and a circular open bottom. The top face of each disk has an indicia printed thereon.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved flying disk game which has all the advantages of the prior art projectile games and none of the disadvantages.

It is another object of the present invention to provide a new and improved flying disk game which may be easily and efficiently manufactured and marketed.

It is a further object of the present invention to provide a new and improved flying disk game which is of a durable and reliable construction.

An even further object of the present invention is to provide a new and improved flying disk game which is susceptible of a low cost of manufacture with regard to both materials and labor, and which accordingly is then susceptible of low prices of sale to the consuming public, thereby making such flying disk game economically available to the buying public.

Still yet another object of the present invention is to provide a new and improved flying disk game which provides in the apparatuses and methods of the prior art some of the advantages thereof, while simultaneously overcoming some of the disadvantages normally associated therewith.

Still another object of the present invention is to flick a flying disk through an obstacle course.

Lastly, it is an object of the present invention to provide a new and improved flying disk game including at least one disk with a top planar circular face and a cylindrical periphery coupled to a peripheral edge of the top planar circular face and depending downwardly therefrom. In use, the disk is placed on a palm of a first hand of a user. Thereafter, the periphery of the disk is flicked with fingers of a second hand of the user thereby imparting flight to the disk.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
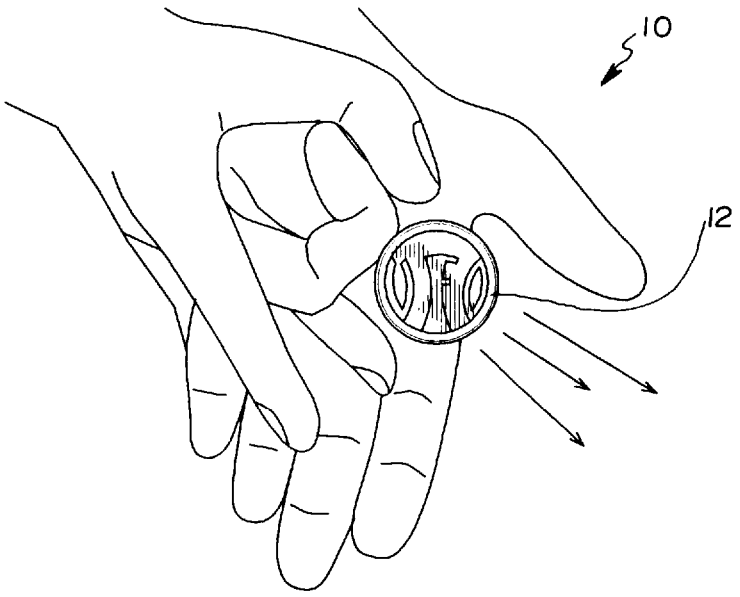
FIG. 1 is a perspective illustration of the preferred embodiment of the flying disk game constructed in accordance with the principles of the present invention.

With reference now to the drawings, and in particular to FIG. 1 thereof, a new and improved flying disk game embodying the principles and concepts of the present invention and generally designated by the reference numeral 10 will be described.

The present invention, the new and improved flying disk game, is comprised of a plurality of components. Such components in their broadest context include a plurality of disks and a method of play. Such components are individually configured and correlated with respect to each other so as to attain the desired objective.

Figure 2:
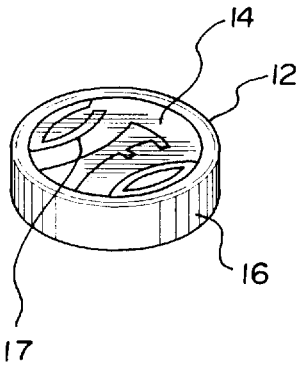
FIG. 2 is a top perspective of one of the disks of the present invention.
Figure 3:
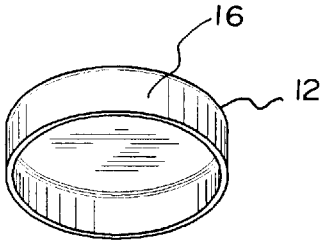
FIG. 3 is a bottom perspective view of the present invention.
Figure 4:
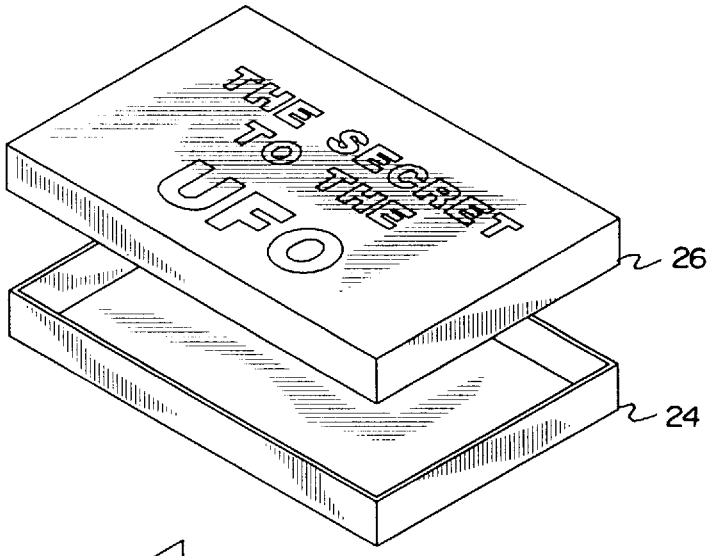
FIG. 4 is a perspective view of the box associated with the present invention.

More specifically, it will be noted that the system 10 of the present invention includes a plurality of disks 12 each with a top planar circular face 14. Coupled to a peripheral edge of the top planar circular face is a cylindrical periphery 16 which depends downwardly therefrom. Note FIGS. 2 & 3. As such, each disk defines an interior space and a circular open bottom. The top face of each disk has an indicia 17 printed thereon.

The plurality of disks of the system 10 preferably includes a light disk with a first weight, a medium disk with a second weight greater than the first weight, and a heavy disk with a third weight greater than the second weight. Such weight differences are accomplished by varying the thickness the circular top faces or, in the alternative, utilizing different materials.

During use, any one of the disks may be positioned with the open bottom engaging a palm of a first hand of a user. Thereafter, fingers of a second hand of the user may be used to flick the disk at the periphery thereof thereby imparting flight to the disk. Prior to flicking the disk, the palm of the first hand may be angled or tilted to effect a curving motion of the disk when in motion. It should be noted that various flight characteristics may be afforded by simply choosing an appropriate one of the plurality of disks. For example, the light disk may be flicked when a user desires to utilize wind and further perform tricky maneuvers. Further, the heavy disk may be flicked for precluding the detrimental effects associated with wind and accomplish greater distances. It is apparent from such discussion that the medium disk may be utilized to afford characters of both the light and heavy disk.

Figure 5:
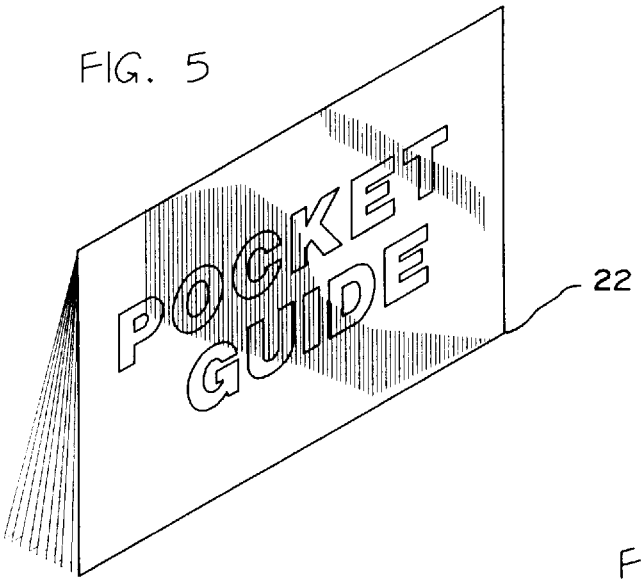
FIG. 5 is a perspective of the rule book of the present invention.
Figure 6:
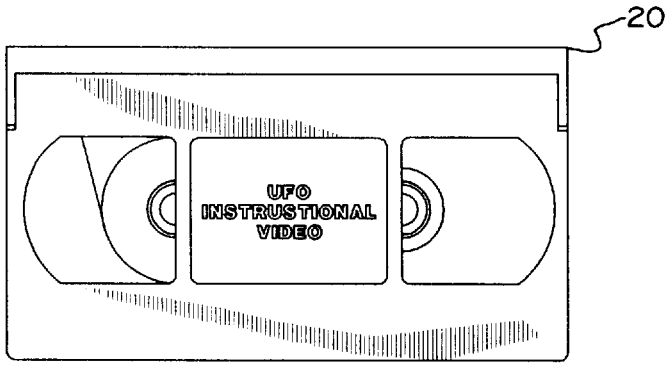
FIG. 6 is a top view of the video cassette tape of the present invention.

A game associated with the present invention will now be set forth. Preferably, the steps associated with the present invention are set forth in a video cassette 20 or a rule book 22, as shown in FIGS. 5 & 6. Such book or cassette is preferably packaged with the various disks in a box 24 with a removable cover 26. Included as a set is a plurality of each of the various weighted disks. As an option, the disks can be color coded or even glow in the dark.

The method associated with the present invention first includes the step of designating an obstacle course with a plurality of distanced entities each with a designated order. Such entities may include a tree, car, house or the like. Next, each of a plurality of players is provided with various weighted disks. Thereafter, each of the players takes turns flicking the disks. During each turn, the disks are flicked once in an attempt to strike each of the entities of the obstacle in order. Alternatively, the object of the game may be to pass on the right or left side of the obstacle or between two obstacles. It is a rule that, when flicking the disk, a single foot of the user must remain stationary at the place that disk landed in a previous turn. Further, the player whose turn it is has the option of utilizing any one of the various weighted disks.

As an option, a player is awarded two extra turns upon striking a disk of another player. Such turns may be taken in one of two different ways. First, the player may flick the disk of another player once and further flick his or her own once. In the alternative, the player may flick his or her disk twice. A pair of extra turns may be awarded only once per turn.

It should be noted that a winner is designated as a player whose disk strikes each of the entities of the obstacle course with the least amount of flicks. It should be noted that the flicks awarded do not count in the forgoing tally.

Another game utilizing the disks will now be described. In such game, goals are set up on opposite sides of a playing area. Next, the players take turns flicking a single disk back and forth toward respective goals. The first player to flick the disk within the goal wins.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A method of flicking a disk comprising the steps of:

providing at least one disk including a top planar circular face and a cylindrical periphery coupled to a peripheral edge of the top planar circular face and depending downwardly therefrom;

designating an obstacle course with a plurality of distanced entities each with a designated order;

placing the disk on a palm of a first hand of a user;

flicking the periphery of the disk with fingers of a second hand of the user thereby imparting flight to the disk; and taking turns flicking the disk wherein during each turn, the disks are flicked to reach each of the entities of the obstacle in order.

2. The method of flicking a disk as set forth in claim 1 and further providing the step of angling the palm of the first hand to effect a curving of the disk when in motion.

3. The method of flicking a disk as set forth in claim 1 and further including the step of providing a light disk with a first weight and a heavy disk with a weight greater than the first weight.

4. The method of flicking a disk as set forth in claim 3 and further including the step of flicking the light disk for utilizing wind when flicking the disk.

5. The method of flicking a disk as set forth in claim 3 and further including the step of flicking the heavy disk for precluding detrimental effects of wind when flicking the disk.

6. A method of flicking a disk comprising the steps of:

providing a plurality of disks each including a top planar circular face and a cylindrical periphery coupled to a peripheral edge of the top planar circular face and depending downwardly therefrom, whereby the disks may be placed on a palm of a first hand of a user and flicked with fingers of a second hand of the user thereby imparting flight to the disk;

designating an obstacle course with a plurality of distanced entities each with a designated order;

providing each player with at least one of the disks;

taking turns flicking the disks whereby during each turn, the disks are flicked to reach each of the entities of the obstacle in order; and designating a winner as a player whose disk reaches each of the entities of the obstacle course with the least amount of flicks.

7. The method of flicking a disk as set forth in claim 6 and further including the step of allowing a player to take extra turns upon striking a disk of another player.

8. The method of flicking a disk as set forth in claim 7 and further including the step of allowing a player to flick the disk of another player upon striking the disk of said player.

* * * * *